United States Patent [19]

Paschal

[11] 4,140,401

[45] Feb. 20, 1979

[54] CLEANING APPARATUS AND METHOD

[76] Inventor: Richard C. Paschal, 865 Bellevue Rd., Apt. D-7, Nashville, Tenn. 37221

[21] Appl. No.: 835,524

[22] Filed: Sep. 22, 1977

[51] Int. Cl.[2] ..... B01F 13/08

[52] U.S. Cl. ..... 366/127; 51/430; 366/274

[58] Field of Search ..... 366/127, 273, 274; 51/7, 430; 294/65.5; 23/253 R; 241/79.1; 210/222, 223; 134/85

[56] References Cited

U.S. PATENT DOCUMENTS

| | | | |
|---|---|---|---|
| 2,976,075 | 3/1961 | Budreck | 294/65.5 |
| 3,219,318 | 11/1965 | Hershler | 366/273 |
| 3,384,353 | 5/1968 | Worth | 366/274 |
| 3,650,698 | 3/1972 | Adler | 23/253 R |
| 3,752,443 | 8/1973 | Lichtenstein | 366/273 |
| 4,046,383 | 9/1977 | Vidnovic | 294/65.5 X |

FOREIGN PATENT DOCUMENTS

| | | | |
|---|---|---|---|
| 1216736 | 12/1970 | United Kingdom | 366/274 |

*Primary Examiner*—Leonard D. Christian
*Attorney, Agent, or Firm*—B. B. Olive

[57] ABSTRACT

A cleaning apparatus for small, ferrometallic, precision items, e.g., dental burs, includes a cabinet unit housing a plurality of magnets mounted on a motor driven, rotatable disc with the magnets being arranged and designed to provide a rotating, unipolar, non-uniform, magnetic field coacting with the items in which individual fields are induced and which provide for rotation separation and oscillation of the dental burs being cleaned in a solution within an appropriate container; a second group of magnets also mounted on a rotatable disc for rinsing of the cleaned dental burs; and a degaussing unit for demagnetizing the dental burs once cleaned and rinsed. A magnetic bur pick-up device allows for moving the dental burs from one area to the next without physical contact of the already cleaned burs.

15 Claims, 16 Drawing Figures

CLEANING APPARATUS AND METHOD

BACKGROUND OF THE INVENTION

1. Field of the Invention

This invention relates to apparatus for cleaning small, ferrometallic, precision items, e.g., dental burs, watch components or small, delicate, precision machine parts. Items of this type acquire debris lodged in grooves and other inaccessible areas and conventional cleaning devices have not provided an adequate means for cleaning such items.

2. Description of the Prior Art

Heretofore, especially in the case of dental burs, the burs had to be cleaned manually with a steel brush which did not get the grooves adequately clean. When debris is allowed to dry in the grooves of the bur, certain dental materials are practically impossible to remove. Other items which need to be cleaned, e.g., watch components and precision machine parts, present similar problems. Many such parts are characteristically non-spherical, of a ferromagnetic material, and are not initially permanently magnetized or designed as permanent magnets as compared to permanent magnets designed as such and formed of ferromagnetic material with a relatively high coercive force. Dentists, watchmakers, machinists and others have been in need of an efficient, economical and expedient means by which various small, metallic articles of the type mentioned can be properly cleaned. As far as is known, a cleaning device which adequately satisfies this need has not previously been available. Although not useful for the purposes of this invention, mixing devices are known which incorporate magnets to achieve the desired stirring effects. For example, U.S. Pat. No. 2,999,673 discloses a magnetic mixing device which utilizes a magnet rotated by a drive motor and a bar of magnetic material placed within a closed fluid path which is caused to rotate by the rotating magnet to establish a mixing condition within the fluid path. U.S. Pat. Nos. 3,995,835 and 3,752,443 provide further examples of magnetic mixers. Also, U.S. Pat. No. 2,573,319 illustrates an inductive stirring device which utilizes magnetic systems in obtaining the desired stirring effect.

While these forms of stirring and mixing utilize magnets, they are not practical for use in cleaning precision items, such as have been noted above. That is, they are impractical largely because there are no means provided for maintaining a separation between any discrete objects which may be placed in the mixing vessel. The real need has been for a device in which a number of items can be cleaned at the same time but which will prevent these items from coming into contact with each other or any other object in the container during the course of the cleaning operation.

SUMMARY OF THE INVENTION

The cleaning apparatus of the present invention includes a cabinet unit which houses a plurality of motor-driven, disc-mounted magnets which are arranged to provide a unipolar, non-uniform, magnetic, rotating field and which causes rotation, separation and oscillation of the items being cleaned by a cleaning solution within a dish or other suitable container. During cleaning, the burs or other items being cleaned are all exposed to a rotating non-uniform field of single polarity generated by the magnets and whose strength relative to the burs fluctuates as the fields rotate. A second group of motor-driven, disc-mounted magnets are also arranged so as to likewise provide for rotation, separation and oscillation of the items while being rinsed in a second container; and a degaussing unit integral with the cabinet unit for demagnitizing the items after they have been both cleaned and rinsed. A magnetic pick-up device is further provided for transferring the items from one container to the next and to the degaussing unit without physical contact once such items have been cleaned. A main power supply switch, individual motor control switches and a degaussing unit control switch are mounted in a control panel on th cabinet unit face area. An ideal cleansing method is created during the cleaning cycle (oscillation and circular movement). In addition, the speed of this motion can be controlled to accommodate varying degrees of intensity.

The device is preferably operated in accordance with the following steps taken in sequence: (1) a fibrous pad made from plastic or other suitable non-magnetic material is inserted on the bottom of a washing container; (2) the wash container is then placed on the unit in an appropriate, marked location; (3) the desired cleaning solution is poured into the wash container after which the main power switch and wash motor switch are turned on; (4) the precision items to be cleaned, e.g., dental burs, are then dropped into the wash container one at a time to obtain an ideal separation which is maintained during the cleaning operation; (5) the magnetic pick-up device is then placed over the top of the wash container and provides a lid therefore; (6) once cleaned, the items are transferred by means of the magnetic pick-up device to the rinsing container positioned on the unit in the rinsing location and the rinse motor switch is turned on; and (7) following the rinsing cycle, the items are transferred again by the magnetic pick-up device to the degaussing unit where all magnetism is removed from the items which have been cleaned and rinsed.

DESCRIPTION OF THE PREFERRED EMBODIMENT

Figure 1:
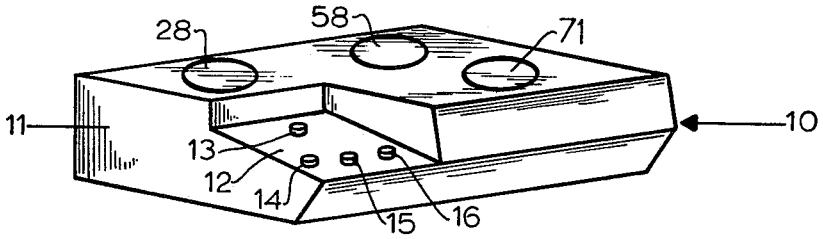
FIG. 1 is a perspective view of the cleaning apparatus of the present invention.
Figure 2:
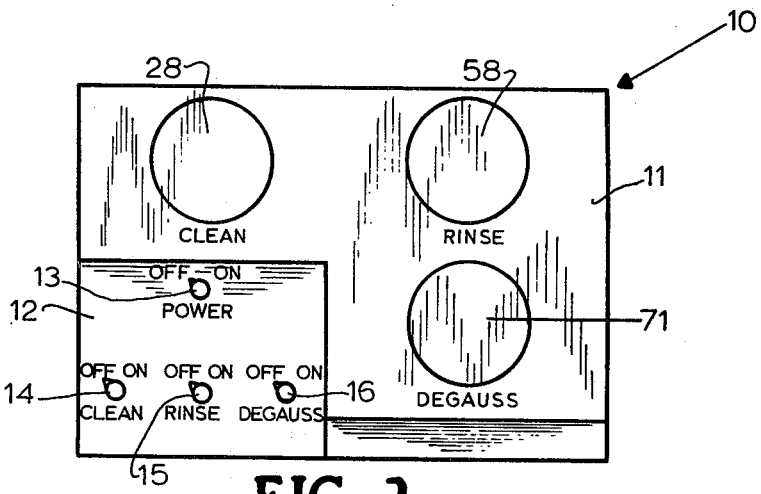
FIG. 2 is a plan view of the cleaning apparatus with appropriate labels and controls shown.
Figure 4:
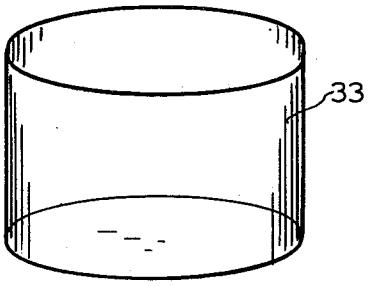
FIG. 4 is a perspective view of a container suitable for use in the present invention.
Figure 3:
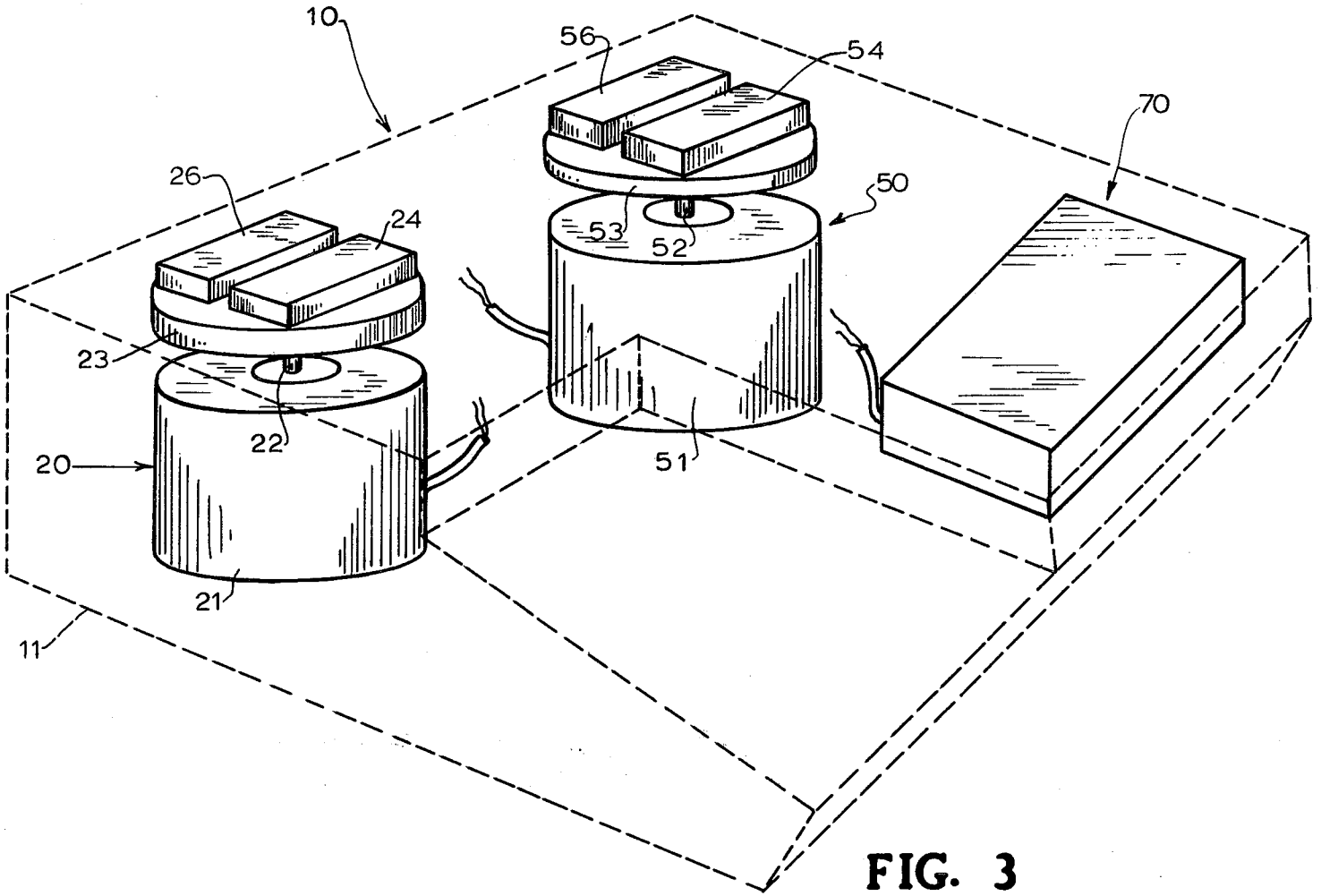
FIG. 3 is a perspective view of the cleaning, rinsing and degaussing apparatus with the cabinet shown in dashed lines.

Referring now to FIGS. 1, 2 and 3, it is seen that the cleaning apparatus designated generally by the numeral 10 is housed within cabinet 11. Cabinet 11 has a control panel 12 which has off/on main power supply switch 13, off/on cleaner switch 14, off/on rinse switch 15 and off/on degaussing switch 16. Control panel 12 is angularly positioned and recessed for good visibility and ease in reaching the proper controls. A very compact and portable cleaning apparatus 10 is generally preferred in most work situations; however, apparatus 10 could easily be built into a counter top to provide a permanent location. The portable unit is deemed most desirable since it is capable of being moved from one area to another.

Figure 10:
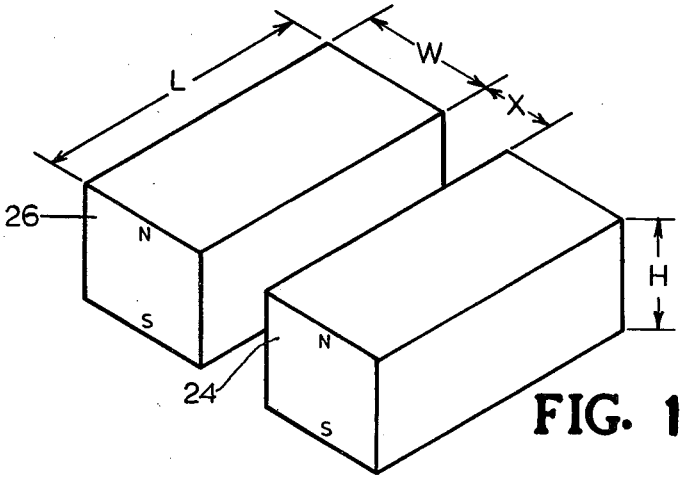
FIG. 10 is a perspective view of one set of magnets used with the present invention with space X, width W, length L and height H being illustrated.

Turning now to a description of the cleaning unit 20, it is seen that the unit is comprised of a drive motor 21, drive shaft 22, rotatable disc 23 and a pair of magnets 24 and 26 which are mounted on rotatable disc 23. As an aid in the proper positioning of the cleaning solution container; the cleaning position 28 is marked as such on the top surface of cabinet 11 as shown in FIG. 2. As best seen in FIG. 10, magnets 24 and 26, which are separated with a short space between them, are rectangular in shape with their longitudinal axes being in parallel arrangement. The magnetization is through the magnets flatwise or parallel to the short axis so that the top surface of both magnets is of the same polarity which may be either north or south. Although not critical, typical dimensions of the magnets which have been successfully employed are: the width W is $\frac{7}{8}$ inch, the length L is $1\frac{7}{8}$ inch and the height H is $\frac{3}{4}$ inch. The gap distance X between the magnets can vary widely depending upon the objects to be cleaned, the motion desired in the objects, and other considerations. Since a separation and oscillating movement of the items to be cleaned can be achieved with the magnets flush against each other, it is conceivable that in some instances, a gap between the magnets could be eliminated. However, where circular movement as well as oscillation and separation are desired, a gap distance between the magnets of from about $\frac{3}{8}$ inch to $\frac{1}{2}$ inch is generally preferred.

Figure 16:
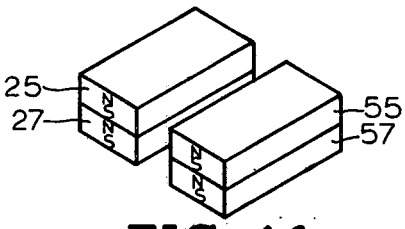
FIG. 16 is a perspective view of a suitable pair of magnets wherein each magnet is obtained by cementing two smaller magnets together.

Suitable magnets need not necessarily be of a single, unitary structure, since the magnet size desired may be obtained by cementing two smaller magnets together. Such an arrangement is illustrated in FIG. 16. As seen, a pair of magnets 25 and 27 are glued or otherwise cemented together such that the flat top and bottom surfaces of the combination have an opposite polarity. Pair 55 and 57 is similarly constructed and the two magnet pairs are arranged so that like poles are aligned and stabilized in repulsion with each other, the "poles" being established by the magnetism being parallel to the short axis as shown.

Figure 9:
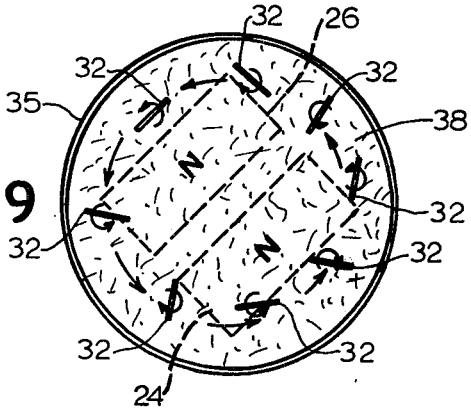
FIG. 9 is a plan view of several dental burs inside a cleaning container and showing the oscillation and rotation of the burs with the magnets illustrated in dashed lines.

Reference is now made to FIG. 9 where items 32 in the cleaning operation are shown to be moving in a circular path and oscillating about their mid-points while they repel each other to maintain separation. If opposite poles of the magnets were uppermost, i.e., facing the items, the oscillation effect and the maintenance of separation would not be obtained but rather the items being cleaned would simply follow the magnets in a circular motion while clinging together. It is the specific arrangements of magnets and the resulting separation and motion of the articles being cleaned and in which poles are induced which makes the cleaning apparatus of this invention unique when compared to previously known magnetic stirring devices.

Figure 11:
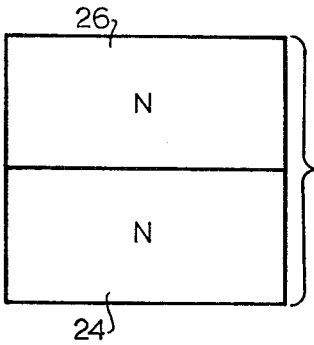
FIGS. 11 through 13 illustrate various spacing arrangements which, among others, may be suitably employed in the present invention.
Figure 14:
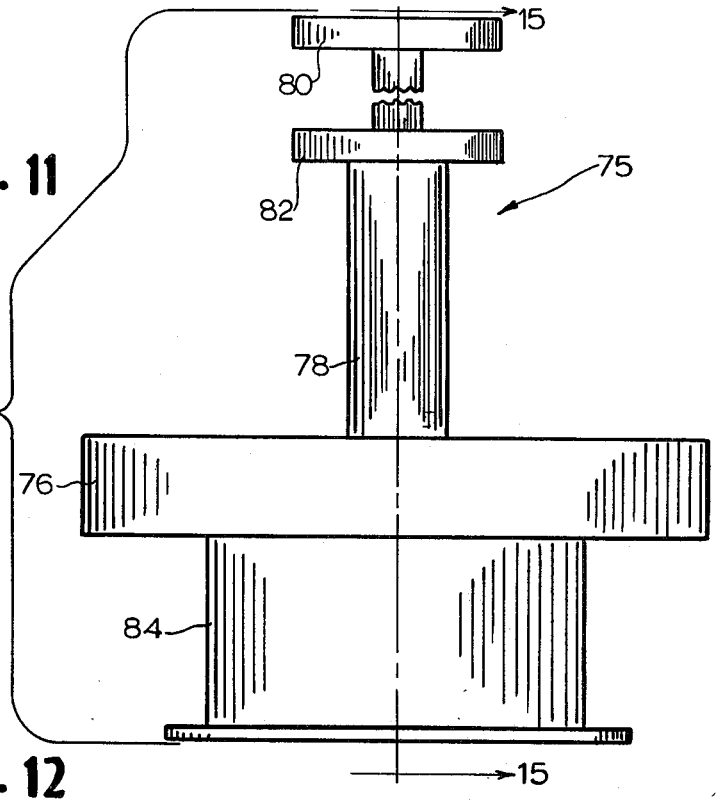
FIG. 14 is a side elevation view of the magnetic pick-up device employed in the present invention.
Figure 12:
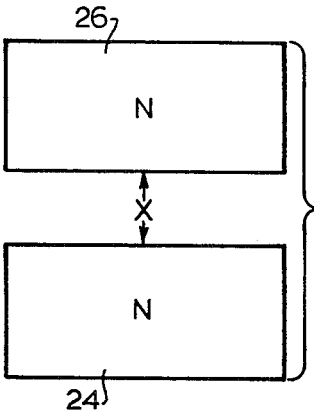
Figure 13:
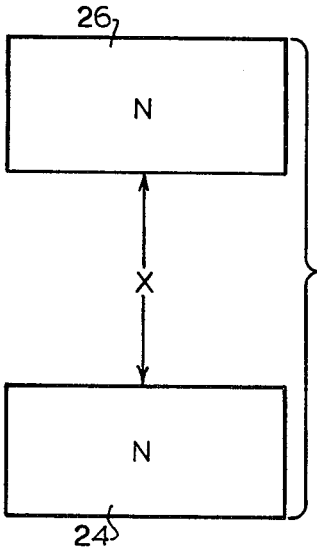

FIG. 11 illustrates a magnet arrangement in which the magnets are not separated by a gap distance. In such arrangement, circular movement is limited but separation and oscillation occur. FIG. 12 illustrates the preferred $\frac{3}{8}$ inch to $\frac{1}{2}$ inch spacing or distance X wherein the desirable circular movement as well as separation and oscillation are realized. FIG. 13 illustrates a magnet arrangement where distance X is $1\frac{3}{8}$ inch which gives little or no oscillation, but which provides separation and circular movement. It is readily apparent that for cleaning dental burs, as contrasted with other items, the arrangement as illustrated in FIG. 12 would definitely be preferred.

Figure 5:
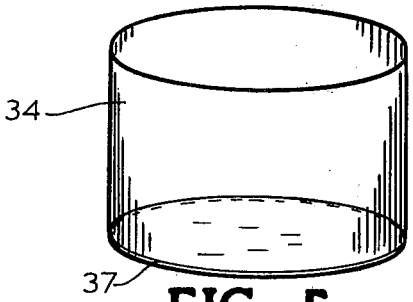
FIG. 5 is a view similar to that of FIG. 4 with a plastic disc insert positioned on the inside base surface of the container.
Figure 6:
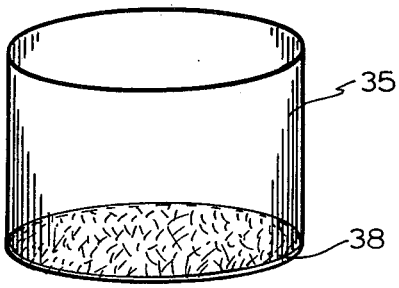
FIG. 6 is a view similar to that of FIG. 5 with the plastic disc insert being provided with bristles.
Figure 7:
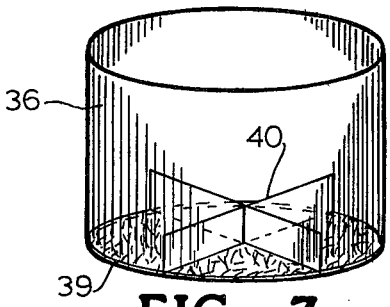
FIG. 7 is a view similar to that of FIG. 6 with the inside of the container being compartmentalized.

FIGS. 4 through 7 illustrate various containers 33, 34, 35 and 36, respectively, which can be employed in this invention. Container 35 is particularly preferred when cleaning dental burs. Container 33 has no protective inserts and can be used but will eventually become worn on the inside bottom by the metallic items being cleaned therein. FIG. 5 illustrates a container 34 which has a removable, plastic disc 37 placed therein to prevent wear on the floor of the container. FIG. 6 illustrates a container 35 having a fibrous disc inserted therein. Once a cleaning solution is placed in container 35, the items 32 can be individually placed therein. FIG. 7 depicts a fourth type container 36 which incorporates a bristled disc insert 39 together with a form 40 for creating compartments within the container. By compartmentalizing the container different type articles can be segregated and cleaned at the same time. Circular movement is restricted in this arrangement but article separation and oscillation are still present.

Figure 8:
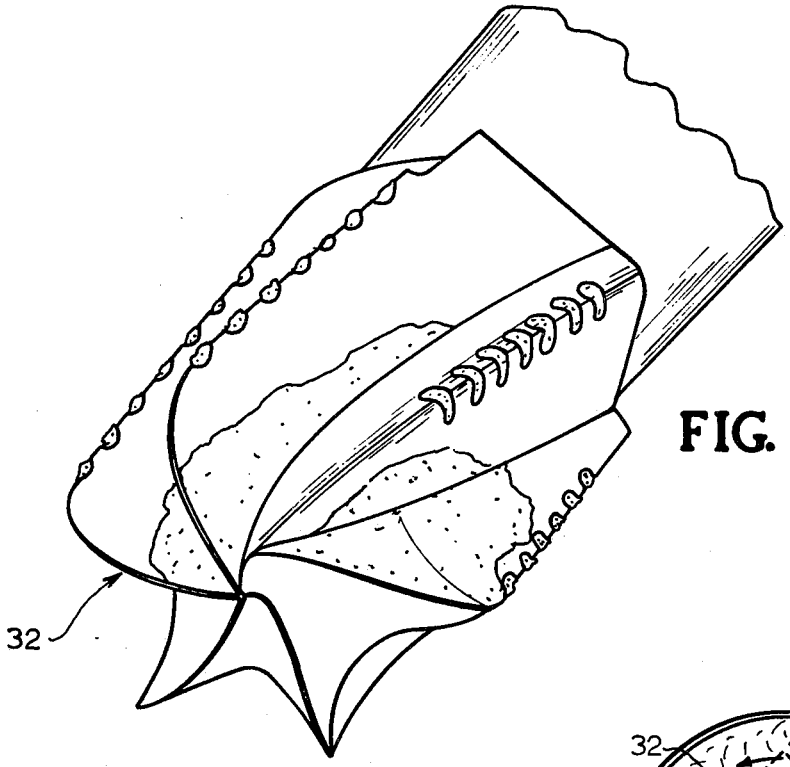
FIG. 8 is an enlarged view of the tip portion of a sample dental bur showing debris accumulated in the teeth of the bur.

In the case of dental burs, an example of which is illustrated in FIG. 8, best results are obtained when the burs are cleaned shortly after use and before the accumulated debris is allowed to dry. That is, dentin, and like materials, are not easily removed from the grooves and crevices of the bur when free of moisture.

Like the previously described cleaning unit, rinse unit 50 is comprised of a drive motor 51, drive shaft 52, rotatable disc 53 and a pair of rectangular magnets 54 and 56. The magnets are arranged as in the cleaning unit in order to achieve the same magnetic effects. Thus, as in cleaning unit 20, a circular and oscillatory motion is imparted to the articles being rinsed while they repel each other to remain apart. A rinsing position 58 is marked on the top surface of cabinet 10 to facilitate proper placement of the container used in this operation.

Magnetism is induced in articles 32 and once articles 32 have been cleaned and rinsed, they are demagnetized by means of a degaussing unit 70. Since this is a readily available and conventional device, it is shown only in box structure at FIG. 3 of the drawings. Demagnitization is accomplished merely by transferring the rinsed articles from the rinsing position onto a sterile cotton pad on the degauss position 71, as shown in FIG. 2, and thence depressing the operational switch 16 (momentary on) to the "on" position. Once in operation, the degaussing device effects a demagnitization of the metallic articles when the operator applies a simple twisting motion while lifting the cotton pad containing the burs away from area 71.

Figure 15:
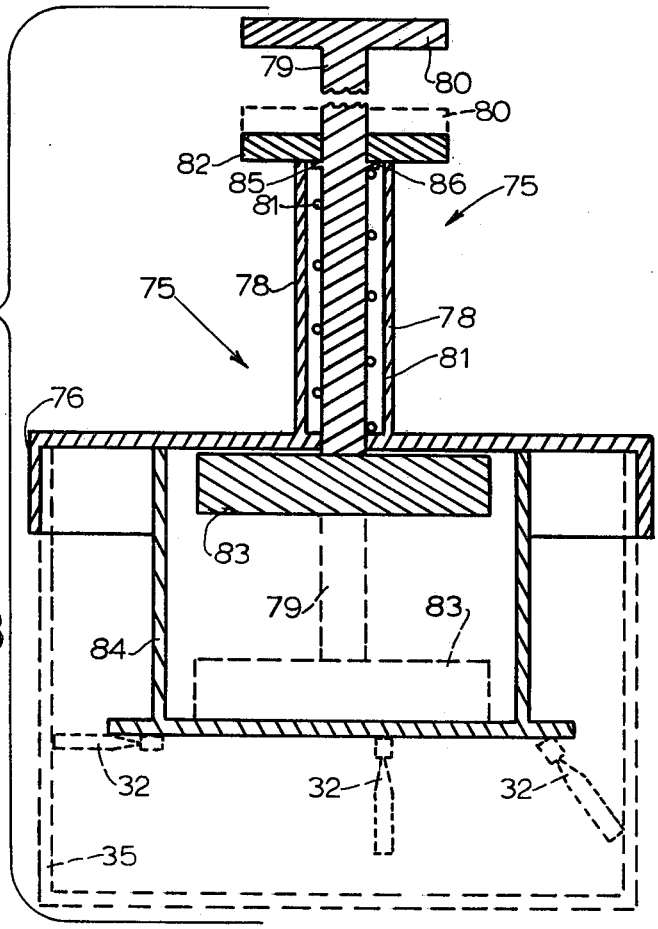
FIG. 15 is a section view through the magnetic pick-up device showing the internal magnet and spring means.

As has been noted, the items being cleaned are transferred from one operational site to the next without manual handling by means of a magnetic pick-up device which is adapted to mate with and fit over the containing means for the metallic articles. Thus, as seen in FIG. 15, cap 76 of the pick-up device 75 fits snugly over the rim of container 35 and in effect forms a lid on the container. Extending upwardly from a center position at the top of cap 76 is a cylindrical housing member 78, which in turn contains a cap member 82 at its upper extremity which receives shaft 79 of plunger element 80. Shaft 79 extends through housing 78 and terminates within enclosure 84 where its lower end is attached to magnet 83. Pins 85 and 86 are secured to shaft 79 at a position immediately below cap member 82 with a coiled spring 81 being likewise secured to the shaft just beneath pins 85 and 86.

It is important to note that the bottom surface of magnet 83 should have the same polarity as the top surfaces of magnets 24 and 26 which are mounted on rotatable disc 23 of cleaning unit 20 and should likewise have a common polarity with magnets 54 and 56 which are mounted on rotatable disc 53 of the rinsing unit 50. This provides substantial advantage in that it increases the flux density of the magnetic field operating on the metallic articles as they are being cleaned and rinsed. This results in noticeably greater oscillation and separation of items being cleaned.

When transferring the items being cleaned from one operational site of the cleaning apparatus to another, it is necessary that the container upon which the pick-up device is positioned be first grasped and lifted free of the surface upon which it has been resting to escape the magnetic field effects of the rotatable magnets underneath the surface. The plunger 80 is then pressed downward to lower magnet 83 to the bottom of enclosure 84. The lowering of the plunger shaft 79, of course, causes compressive tension on spring 81. In the lowered position, shown by dashes in FIG. 15, magnet 83 attracts the metallic objects 32 within container 35 and they are picked up and held until released by removing the downward pressure on plunger 80 which allows magnet 83 to return to its normal position by action of spring 81 on shaft 79.

While not disclosed, it is also recognized that ferromagnetic material of appropriate configuration could be placed immediately above the burs or other items during cleaning to serve as a flux path for more efficient flux transmission as opposed to an air path as illustrated. However, it is also recognized that such a ferromagnetic structure would introduce both additional cost and additional handling time for proper placement, adjustment, and the like.

As has been noted, the metallic objects are caused to move during the cleaning operation while each object maintains its own space of occupancy. This ideal cleaning condition is accomplished by rotating magnets magnetized along the short axis to provide a rotating, unipolar, non-uniform field and with the magnets being preferably mounted with a slight spacing between them. The items being cleaned are thus exposed primarily to a magnetic flux of single polarity, which can be either north or south depending on whether north or south surfaces are uppermost. The strength of such field relative to the items being cleaned fluctuates in magnitude as the magnets rotate beneath the items being cleaned. The burs or other items being cleaned are thus given induced poles of like polarity due to exposure in a rotating field of single polarity.

The rotational speed, flux strength and spacing between the magnets can vary widely with the optimum values for these parameters being largely dependent upon the particular objects which are to be cleaned. In the case of dental burs, it has been found that a ½ inch spacing between the magnets and a rotational speed of from about 1000 to 1500 RPM is particularly effective. However, this will vary with objects of a different size and configuration.

While the invention has been described and illustrated with particular reference to the preferred embodiments thereof, it will be appreciated that certain modifications will readily occur to those skilled in the art which clearly fall within the general concepts and scope of the invention. For example, more than two rotatable magnets may be used in operating the cleaning and rinsing units, or on the other hand, a single motor could be employed to power both units by connecting their rotatable shafts with a belt drive. Moreover, the apparatus could be used to clean non-magnetic articles by the use of ferrometallic grasping clips or other types of magnetic carriers. What is deemed important in all such cleaning operations is to place the burs or other items in a rotating field of changing or non-uniform strength of single polarity, either in the manner described or in any magnetically equivalent manner. The preferred example of two spaced linearly magnetized rectangular bar magnets establishes two spaced poles of like polarity with respective fields rising perpendicular to the pole surfaces and with the pole strength being different at different points on the magnet surface. Thus, as such a single polarity, non-uniform magnetic field source rotates relative to the burs or other items, the items are exposed to a field of single polarity but of constantly changing strength and the items are given induced poles. Equivalent means of establishing such a rotating field could thus be used with the same results expected.

I claim:

1. An apparatus for facilitating the cleaning of a plurality of small ferrometallic articles, such as dental burs, with a cleaning solution, said apparatus comprising in combination:

(a) a cleaning unit having a plurality of bar magnets mounted on a rotatable disc, said magnets being arranged and magnetized with respect to the poles thereof to create a non-uniform field of single polarity above said magnets;

(b) a separate rinsing unit laterally spaced from said cleaning unit and having a plurality of similar bar magnets mounted on a rotatable disc and arranged in a similar manner;

(c) drive means for effecting rotation of said discs to cause rotation of said non-uniform fields;

(d) a degaussing unit laterally spaced from said cleaning and rinsing units for effecting a demagnitization of said ferrometallic articles after being cleaned and rinsed;

(e) container means having an open upper end for containing said ferrometallic articles in a said cleaning solution when in operational position above said cleaning unit and for positioning said articles in respective operating position above said rinsing and degaussing units;

(f) a transfer element for transferring said ferrometallic articles from one said unit to another without requiring human contact therewith and adapted to fit over and mate with said container means to form a lid on the open end thereof, and transfer element being provided with an enclosed chamber at its lower end adapted for positioning within said container and having a magnet movably mounted therein, said magnet being arranged such that its bottom surface has the same polarity as the top surfaces of said magnets mounted on said rotatable discs, and means for lowering and raising said magnet within said enclosed chamber such that when in the lowered position said articles are brought within the magnetic field of said magnet and are thereby caused to attach to the bottom of said enclosed chamber and when the magnet is raised said articles are released therefrom; and (g) cabinet means housing said magnets, discs, drive means and degaussing unit and providing an operating surface and spaced surface stations above the respective said units for supporting said container means.

2. The apparatus in accordance with claim 1 wherein the magnets mounted on said rotatable discs are parallel and laterally spaced.

3. The apparatus in accordance with claim 1 wherein a pair of magnets are mounted on each of said rotatable discs.

4. The apparatus in accordance with claim 1 wherein said container means includes a plastic fibrous disc insert positioned on the bottom thereof.

5. The apparatus in accordance with claim 1 wherein said container means has a compartmentalizing form positioned therein.

6. The apparatus of claim 3 wherein each of said pair of magnets consists of two magnets magnetized along their respective short axis and joined together with opposite poles being joined at the interface and wherein the uppermost surfaces of said composite magnets are of the same polarity.

7. An apparatus for cleaning a plurality of ferromagnetic articles having adhered matter to be removed while such articles are held and agitated in a liquid, comprising:

(a) cabinet means formed of non-ferromagnetic material providing an enclosure and a top surface operating area thereon;

(b) container means formed of non-ferromagnetic material for containing said articles on an interior bottom surface thereof and in a liquid while said container rests within said surface operating area; and (c) a cleaning unit having a powered rotatable support positioned below said surface operating area and having a vertical axis of rotation extending through and centrally of said operating area, a pair of similar elongated bar magnets of uniform rectangular cross section mounted on said support, spaced apart laterally and with the long axis thereof parallel, said space between said magnets being penetrated by said vertical axis at a location centrally of the width and length of said space, said bar magnets being magnetized parallel to the short axis thereof and arranged on said support such that the upper faces thereof are disposed in a common horizontal plane and present upper faces of the same polarity so as to create a magnetic field penetrating said surface operating area and rotating about said vertical axis and providing a field strength of single polarity and of substantially varying and nonuniform character in said operational area during each cycle thereof such that when said container means containing said articles and liquid is placed centrally within said operating area said field is further characterized by effecting a tendency for each of said articles to have poles induced therein, to rotate above the interior bottom surface of said container means about central vertical axis to repel each other and maintain a spaced relation during said rotation and for each article to oscillate about a vertical axis passing through the respective said article.

8. The apparatus of claim 7 wherein each of said bar magnets consists of two bar magnets joined together with inner planar faces of opposite polarity joined at an interface and presenting outer planar surfaces of opposite polarity in each of the composite bar magnets so formed.

9. An apparatus as claimed in claim 7 wherein said container means has an open upper end and including:

an auxiliary magnet device adapted to fit over and mate with said upper open end of the container means to form a lid on the open end thereof, said auxiliary magnet device being provided with an enclosed chamber at its lower end adapted for positioning within said container means and having an auxiliary magnet movably mounted therein, said auxiliary magnet being arranged such that it presents a bottom surface of the same polarity as the polarity of said upper surfaces of said bar magnets mounted on said rotatable support, and means for lowering and raising said auxiliary magnet within said enclosed chamber such that when in the lowered position said articles are brought within the magnetic field of said auxiliary magnet and when the auxiliary magnet is raised said articles are released therefrom.

10. A method of stirring a volume of fluid comprising:

generating a unipolar, nonuniform, magnetic field by mounting a pair of bar magnets magnetized parallel to the short axis in a side-by-side, spaced apart, parallel arrangement on a rotatable support with upper planar faces of like polarity disposed in the same horizontal plane and rotating said support and bar magnets about a vertical axis centered widthwise and lengthwise of the space between said magnets and supporting a fluid volume containing a selected number of ferromagnetic articles in said magnetic field so that said selected number of articles coact with said magnetic field, have induced poles formed therein, repel each other and are rotatably moved about said central axis in uniformly maintained spaced locations and while so rotating each said article is caused to also oscillate around an axis parallel to said central axis and passing through said article and which latter axis through each said article is caused to move with each said article while so rotating.

11. A method as claimed in claim 10 wherein said articles comprise bar-like ferromagnetic articles.

12. A method as claimed in claim 11 wherein said articles comprise non-permanently magnetized articles.

13. An apparatus for stirring a liquid, comprising:

(a) a stirring unit having a pair of bar magnets mounted on a powered rotatable support, said magnets being magnetized parallel to the short axis thereof and arranged on the rotatable support side by side, parallel and in a predetermined spaced apart relation and so as to present upper planar faces of like polarity disposed in the same horizontal plane, said support and magnets being rotatable about a common vertical axis centered widthwise and lengthwise of the space between said magnets to create a nonuniform field of single polarity above said magnets and rotating around said axis;

(b) container means containing a polarity of ferromagnetic articles in a liquid and in operational position above said stirring unit; and (c) cabinet means housing said stirring unit and providing an operating surface spaced above said cleaning unit for supporting said container means.

14. An apparatus as claimed in claim 13 including:

an auxiliary magnet device adapted to fit over and mate with said container means to form a lid on the open end thereof, said auxiliary device being provided with an enclosed chamber at its lower end adapted for positioning within said container means and having an auxiliary magnet movably mounted therein, said auxiliary magnet presenting a bottom planar surface of the same polarity as the polarity of said upper surfaces of said bar magnets mounted on said rotatable support, and means for lowering and raising said auxiliary magnet within said enclosed chamber such that when in the lowered position said articles are brought within the magnetic field of said auxiliary magnet and when the auxiliary magnet is raised said articles are released therefrom.

15. A method of stirring a volume of fluid comprising:

generating a unipolar, nonuniform, magnetic field by mounting a pair of magnetic field source means in a side-by-side, spaced apart arrangement on a rotatable support and wherein said pair of magnetic field source means are of a type presenting upper rectangular planar faces of like polarity disposed in the same horizontal plane and rotating said support to cause said planar faces to rotate about a vertical axis centered widthwise and lengthwise of the space therebetween and supporting a fluid volume containing a selected number of ferromagnetic articles in the composite magnetic field produced by said pair of magnetic field source means so that said selected number of articles coact with said magnetic field, have induced poles formed therein, repel each other and are rotatably moved about said central axis in uniformly maintained spaced locations and while so rotating each said article is caused to also oscillate around an axis parallel to said central axis and passing through said article and which latter axis through each said article is caused to move with each said article while so rotating.

* * * * *

UNITED STATES PATENT OFFICE

CERTIFICATE OF CORRECTION

Patent No. 4,140,401 Dated February 20, 1979

Inventor(s) Richard C. Paschal

It is certified that error appears in the above-identified patent and that said Letters Patent are hereby corrected as shown below:

Col. 2, line 12, "th" should be --the--.

Col. 7, line 11, "and" should be --said--.

Col. 8, line 17, insert --said-- after "about".

Signed and Sealed this

*Fifth* Day of *June 1979*

[SEAL]

*Attest:*

RUTH C. MASON
*Attesting Officer*

DONALD W. BANNER
*Commissioner of Patents and Trademarks*